US007978200B1

(12) United States Patent
Small et al.

(10) Patent No.: US 7,978,200 B1
(45) Date of Patent: Jul. 12, 2011

(54) RASTER-ORDER PIXEL DITHERING

(75) Inventors: Jeffrey A. Small, Rochester, NY (US); John S. Childs, Rochester, NY (US); Jeffrey Lillie, Mendon, NY (US); Vladimir Misic, Rochester, NY (US)

(73) Assignee: National Semiconductor Corporation, Santa Clara, CA (US)

( * ) Notice: Subject to any disclaimer, the term of this patent is extended or adjusted under 35 U.S.C. 154(b) by 745 days.

(21) Appl. No.: 11/648,839

(22) Filed: Dec. 28, 2006

(51) Int. Cl.
*G09G 5/36* (2006.01)

(52) U.S. Cl. ..... 345/559; 345/581; 345/564; 345/565; 345/562

(58) Field of Classification Search ..... None
See application file for complete search history.

(56) References Cited

U.S. PATENT DOCUMENTS

| | | | | |
|---|---|---|---|---|
| 5,111,310 | A | 5/1992 | Parker et al. | 358/456 |
| 5,555,103 | A | 9/1996 | Anderson | 358/456 |
| 5,586,203 | A | 12/1996 | Spaulding et al. | 382/270 |
| 6,081,252 | A | 6/2000 | Reddy | 345/153 |
| 6,271,936 | B1 * | 8/2001 | Yu et al. | 358/3.04 |
| 6,509,927 | B1 * | 1/2003 | Prater et al. | 348/222.1 |

OTHER PUBLICATIONS

Paul J. Lederer et al., "Clinical Use of Contrast Sensitivity Evaluation for General Practice of Optometry," *Journal of Cataract Practical Optometry*, 3(1): pp. 34-48, 1992.

Lawrence F. Jindra et al, "Contrast Sensitivity Testing: A More Complete Assessment of Vision," *Journal of Cataract and Refractive Surgery*, 15(2): pp. 141-148, 1989.

Peter G. Anderson, "Linear Pixel Shuffling for Image Processing, an Introduction," *The Journal of Electronic Imaging*, Apr. 1993, pp. 147-154.

Peter G. Anderson, "Error Diffusion Using Linear Pixel Shuffling," Proceedings of the Imaging Science and Technology Conference, Portland, Oregon, *PICS 2000*, Mar. 2000 pp. 231-235.

J. Arney, et al., "Linear pixel Shuffling (II): An Experimental Analysis of Tone and Spatial Characteristics," IS&T Conference, Vancouver, BC Canada, *NIP2000*, Oct. 2000 pp. 807-809.

Robert Ulichney, Digital Halftoning, Chapter 8: Dithering with Blue Noise pp. 233-331; Chapter 9: 333-344, *MIT Press*, 1987.

Theophano Mitsa et al., "Digital Halftoning Technique using a Blue-Noise Mask," *Journal of the Optical Society of America*, A,9(11) pp. 1920-1929, Nov. 1992.

Niklaus Wirth, "Algorithms and Data Structures," *Prentice-Hall, Inc.* 1986, pp. 269-279.

Qing Yu et al, "Digital Multitoning with Overmodulation for Smooth Texture Transition," *The Journal of Electronic Imaging*, Jul. 8, 1999, 8(3): pp. 311-321.

Vladimir Misic et al., "Algebraic Masks for Color Halftoning," *SPIE2005*, vol. 5667: pp. 481-487.

Lawrence G. Roberts, "Picture Coding Using Pseudo-Random Noise," *IRE Trans. Infor. Theory*,vol. IT-8 pp. 145-154, Apr. 1961.

* cited by examiner

*Primary Examiner* — Kee M Tung
*Assistant Examiner* — Jwalant Amin

(57) ABSTRACT

Stochastic dithering may be used to reduce the size of the frame buffer and the complexity of the D/A Converters (DACs) in the drive circuitry that are used in a video display system. Hardware for stochastic dithering can be simplified when pixel data is presented in raster order. The hardware adds algebraic noise to the image to be dithered, and thresholds the result.

20 Claims, 4 Drawing Sheets

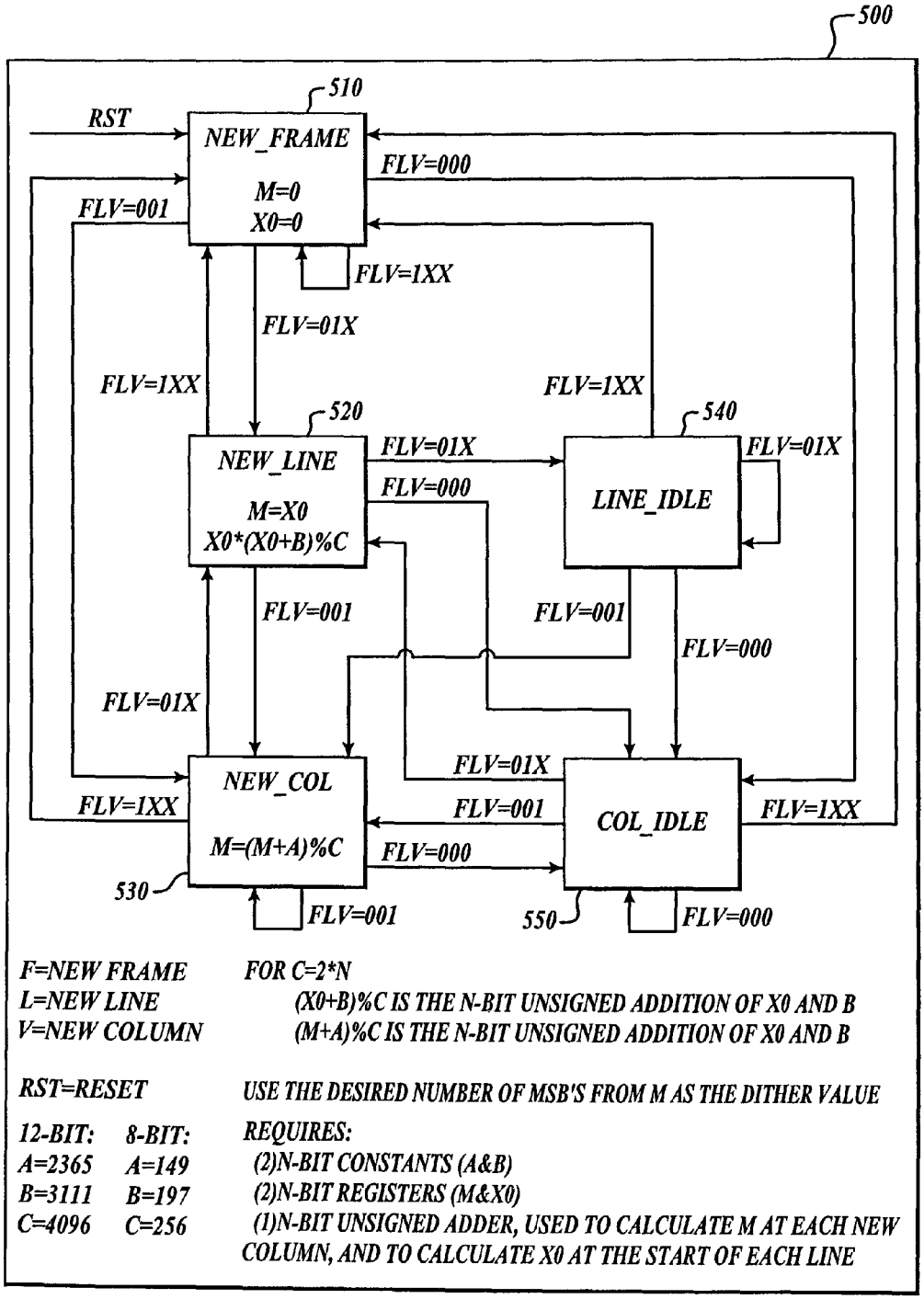

F=NEW FRAME
L=NEW LINE
V=NEW COLUMN

RST=RESET

| 12-BIT: | 8-BIT: |
|---|---|
| A=2365 | A=149 |
| B=3111 | B=197 |
| C=4096 | C=256 |

FOR C=2*N
(X0+B)%C IS THE N-BIT UNSIGNED ADDITION OF X0 AND B
(M+A)%C IS THE N-BIT UNSIGNED ADDITION OF X0 AND B

USE THE DESIRED NUMBER OF MSB'S FROM M AS THE DITHER VALUE

REQUIRES:
(2)N-BIT CONSTANTS (A&B)
(2)N-BIT REGISTERS (M&X0)
(1)N-BIT UNSIGNED ADDER, USED TO CALCULATE M AT EACH NEW COLUMN, AND TO CALCULATE X0 AT THE START OF EACH LINE

FIG.5

RASTER-ORDER PIXEL DITHERING

FIELD OF THE INVENTION

The present disclosure generally relates to image processing. More particularly, the present disclosure relates to dithering of pixels having a reduced bit-depth.

BACKGROUND

An important feature of small electronic devices is their display, which is often used to present a high-quality color image having limited dimensions at a low price. One of the ways to keep the physical dimensions of a pixel driver chip small (and thus to keep associated production costs low), and to keep power consumption low, is to decrease the amount of information that is used to describe the image. The decrease can be accomplished by reducing the number of bits used to describe each pixel, as well as by using advanced dithering algorithms that are used to try to make the reduction visually imperceptible.

A majority of the space on the pixel driver chip is typically occupied by a memory that is used to store image pixels. In many small electronic devices the image is stored as 18 bpp (bits per pixel), which is typically organized as six bits per pixel per color (bppc). Accordingly, when the number of the bits used to represent the image is reduced, the cost of the chip is also reduced.

The Human Visual System (HVS) is normally less sensitive to blue colors, so many imaging applications use half of the number of bits for the blue color channel that are used for other color channels. For example, color bit depths can be organized as a 5-5-2 bpp or 5-5-3 bpp scheme, which are used to represent red, green and blue pixels, respectively. However, in a display driver chip of conventional architecture, all of the color channels data are usually transferred using the same data bus. Accordingly, reduction in numbers of blue color plane bits does not necessarily further simplify the hardware, but instead usually adversely affects the image quality.

BRIEF DESCRIPTION OF THE DRAWINGS

Non-limiting and non-exhaustive embodiments are described with reference to the following drawings.

FIG. 5 is a state diagram illustrating logic states of a raster-order algebraic noise generator in accordance with the aspects of the present invention.

DETAILED DESCRIPTION

Figure 1:
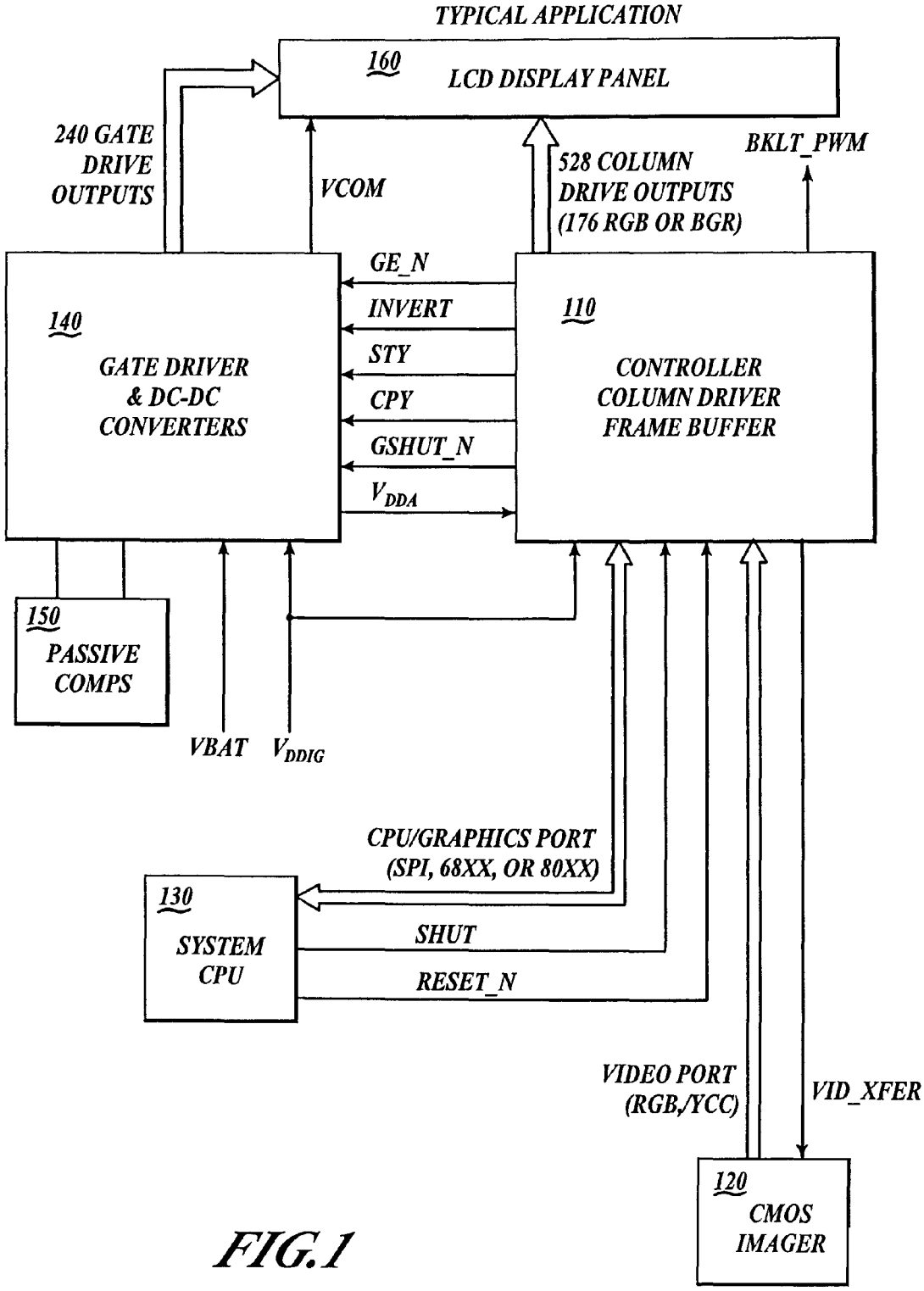
FIG. 1 is a schematic diagram of a computer system for implementing aspects of the present invention.

Various embodiments will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for use of the terms. The meaning of "a," "an," and "the" may include reference to both the singular and the plural. The meaning of "in" may include "in" and "on." The term "connected" may mean a direct electrical, electro-magnetic, mechanical, logical, or other connection between the items connected, without any electrical, mechanical, logical or other intermediary therebetween. The term "coupled" can mean a direct connection between items, an indirect connection through one or more intermediaries, or communication between items in a manner that may not constitute a connection. The term "circuit" can mean a single component or a plurality of components, active and/or passive, discrete or integrated, that are coupled together to provide a desired function. The term "signal" can mean at least one current, voltage, charge, data, or other such identifiable quantity Briefly stated, the present disclosure generally relates to image processing algorithms used to reduce color depth from, for example, 18 bpp to 12 bpp without significant visual artifacts. The algorithm implementations typically use less memory and use only basic arithmetic operations, facilitating the implementation of the architecture in hardware. Because the algorithm does not depend on the order of processing of image pixels or image color components, conventional chip configurations can be used, which can significantly reduce the cost of designing pixel driver chips.

In order to decrease screen bit-depths for pixels (which limits the number of output colors), a multitoning algorithm can be used. Color halftoning (which is typically used in multilevel printing devices) is typically similar to black and white halftoning, where each tone is typically represented by a single binary digit. Each color plane can be dithered independently, and halftone images (color planes) are usually printed on top of each other. Multitoning is similar to color halftoning, except that color planes are not usually represented by single binary digits, but rather the bit-depth of the pixels in each color plane is reduced.

FIG. 1 is a schematic diagram of a computer system for implementing aspects of the present invention. System 100 comprises controller 110, CMOS imager 120, system CPU 130, gate driver 140, passive components 150, and LCD display panel 160. Controller 110 is configured to receive, for example, a video signal from CMOS imager 120 or system CPU 130. Controller 110 comprises a video buffer that is configured to receive the video signal. System CPU 130 can be configured to process information contained in the video signal received by controller 110. Controller 110 is further configured to present video information stored in the video buffer for displaying on LCD display panel 160. LCD display panel 160 is driven by column drivers that are typically comprised by controller 110 and by gate driver 140. Gate drivers 140 typically operate in response to control signals provided by controller 110. Gate drivers 140 also technically comprise DC-DC converters, which can be stabilized by using passive components 150.

Figure 2:
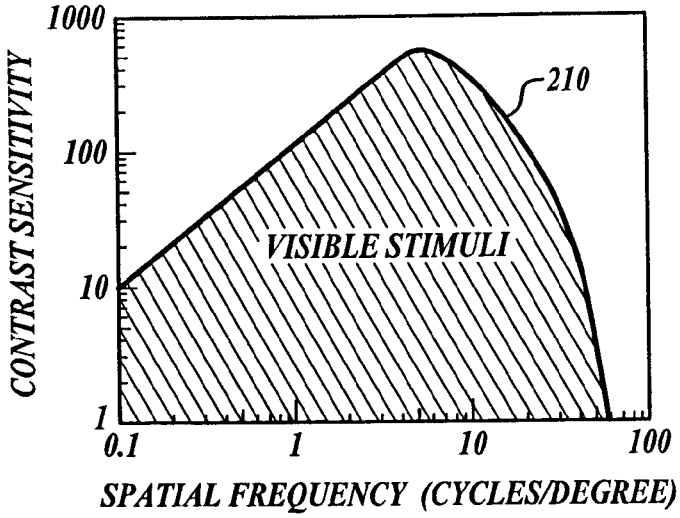
FIG. 2 is a graph representing the contrast sensitivity of a typical human vision system.

FIG. 2 is a graph representing the contrast sensitivity of a typical human vision system. Beyond a spatial frequency of approximately 5 cycles/degree, the contrast sensitivity (shown by curve 210) of the human visual system (HVS)

normally decreases with increasing spatial frequency. As a consequence, the minimum threshold above which pattern-like artifacts are visible usually rises with increasing spatial frequency. One approach for increasing spatial frequency is to select low-contrast color combinations wherever possible and to generate finely drawn non-overlapping patterns. Accordingly, bright colors can be dithered using non-overlapping patterns of red, green and blue. Additionally, using finely drawn patterns helps to reduce the visibility of dithering artifacts.

Figure 3:
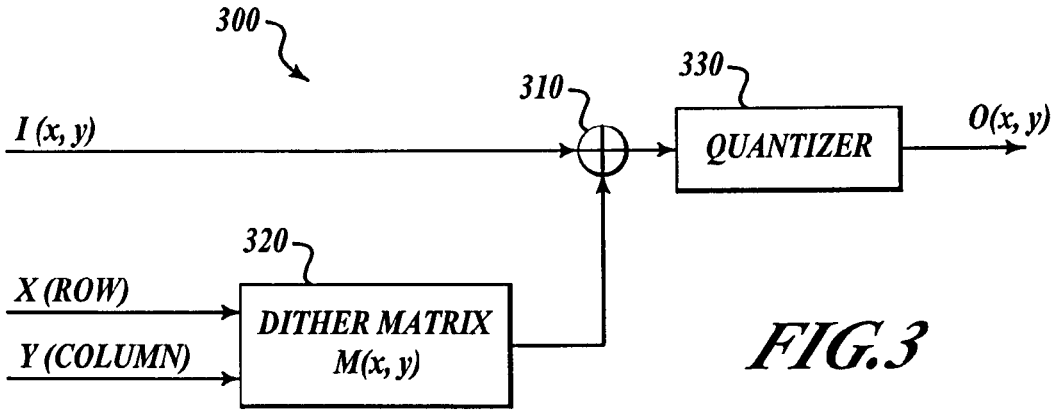
FIG. 3 is a schematic diagram of a circuit for dithering pixel values in accordance with aspects of the invention.

FIG. 3 is a schematic diagram of a circuit for dithering pixel values in accordance with aspects of the invention. Circuit 300 comprises adder 310, dither matrix 320, and quantizer 330. Adder 310 is configured to add dither matrix values retrieved from dither matrix 320 to pixels from input video signal I. Input video signal I typically comprises frames, are organized as rows and columns. Accordingly, the Cartesian coordinates x and y can be used to select individual pixel values within input video signal I and dither matrix 310. Quantizer 330 is arranged to truncate and/or round values received from adder 330 to produce video output signal O.

Algebraic noise generation is a method for the creation of dispersed dot dithering screens, which uses only simple arithmetic operations. Algebraic noise generation can be considered to be similar to conventional two-dimensional hashing algorithms because of the ability to generate non-clustering hash keys. Likewise, algebraic noise features non-clustering of dither thresholds.

A threshold value $M_{xy}$ in a algebraic noise dithering matrix can be defined as:

$$M_{xy}=(A\cdot x+B\cdot y)\mathrm{mod}C \tag{1}$$

where, xy denotes Cartesian "(x, y)" coordinates for matrix element M, the "mod" operator denotes a modulo operation, and A, B, and C represent arbitrarily chosen values. $M_{xy}$ can be scaled to a desired dithering amplitude and then offset so that its mean value is zero.

Algebraic noise has the characteristics of a good dithering pattern. A good dithering pattern has a uniform distribution of brightness levels, contains mainly high spatial frequencies, and appears to be random (or approximately random), with little visible structure. The pattern can be repeated using a "C" by "C" tile size, and C can easily be made relatively large.

Figure 4:
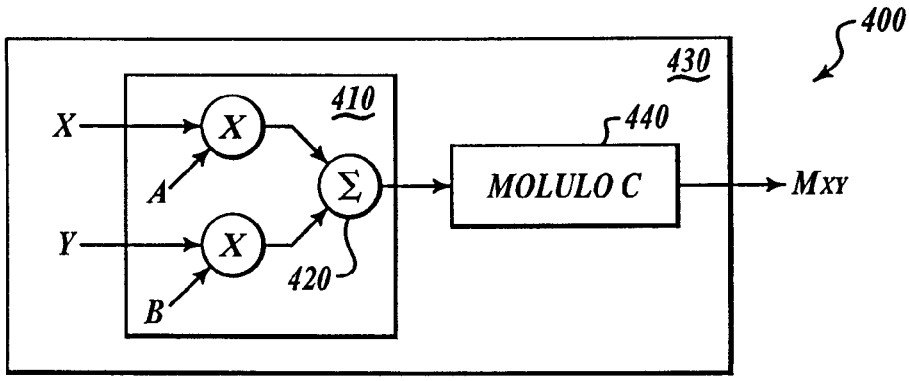
FIG. 4 is a schematic diagram of an algebraic noise generator for generating algebraic noise in accordance with aspects of the invention.

FIG. 4 is a schematic diagram of an algebraic noise generator for generating algebraic noise in accordance with aspects of the invention. Algebraic noise generator 400 comprises multipliers 410 and 420, adder 430 and modulo function 440. Algebraic noise generator 400 can be used to implement Equation (1) when an input image is not provided in raster order.

In Equation (1), the threshold values can range from 0 to C−1. When A, B, and C are mutually prime (e.g., contain no factors in common), the threshold values are dispersed over the dithering matrix, which has dimensions of C-by-C. Also, dithering masks do not need to be tiled across the image because the threshold value can be calculated for each image pixel as the image is being processed, which are based on the pixel coordinates (x, y). Accordingly, the effect of dither matrix tiling can be implicitly accomplished by applying algebraic thresholding as shown in Equation (1).

In an embodiment, the bit-depth of the image color component can be reduced by pixelwise adding a stochastic halftoning screen (such as a threshold or dithering matrix) to a component intensity matrix, and to set the appropriate number of the lowest bitplanes to zero. The amplitude of the dithering modulation in bits plus the bit-depth of the truncated result should be greater than or equal to the bit-depth of the input. For example, a color component for a pixel can be truncated from eight bits to five bits, with dithering modulation added to the color components of each pixel prior to the truncation. Moreover, each truncated color component can be "over-modulated" by adding four bits of dithering modulation prior to the truncation from eight bits to five bits.

Multitoning algorithms can be used to calculate a device output $O_{x,y}$ at the pixel position of (x, y) as:

$$O_{x,y}=\lfloor \mathrm{IMG}_{x,y}(2^q-1)/(2^p-1)+M_{x,y}/256\rfloor \tag{2}$$

where $\mathrm{IMG}_{x,y}$ represents the image intensity value at (x, y), parameter p is number of bits in the input color plane, and q is number of bits in the target bitplane, $M_{x,y}$ represents the threshold value in dithering matrix M, and 256 is number of thresholds in a standard dithering matrix. When algebraic noise is being used, the number of thresholds in dithering matrix is a function of parameter C, such that M can be normalized by dividing by C as shown in Eq. (3) below. The "⌊*⌋" is a rounding operator which, for example, can round the number to the nearest smaller integer value. Accordingly, the device output can be given as:

$$O_{x,y}=\lfloor \mathrm{IMG}_{x,y}(2^q-1)/(2^p-1)+M_{x,y}/C\rfloor \tag{3}$$

where $O_{x,y}$ is in the range $[0:2^q-1]$, $\lfloor \mathrm{IMG}_{x,y}$ is in the range $[0:2^p-1]$, and $M_{x,y}$ is in the range $[0:C-1]$.

An algorithm based on Equation (3) can be implemented using different halftoning screens for different color components, which minimizes visual artifacts. However, using halftoning in small electronic devices is often not cost efficient because good fixed halftoning screens typically require dimensions of at least 256×256 pixels. The storage of such a large dither matrix in a display driver chip is not usually cost-effective.

The goal of bit-depth reducing algorithms for generating multitone screens in small electronic devices is to reduce production costs of the display driver chip. The cost can be reduced by reducing the amount of memory used to store the dither matrix (whereas the use of pre-set screens would require a significant amount of costly memory). If an error diffusion algorithm for bit-depth reduction is used (instead of the bit-depth reducing algorithm) additional memory would be required to record at least one row of the displayed image (and possibly three rows if the image is transferred in interleaved mode—one row from each color plane at the time). Error diffusion also requires at least four adders and several fixed-constant multipliers. Use of the bit-depth reducing algorithm of the present invention does not typically require memorization of the threshold values, or memorization of the dithering error because the threshold values and the dithering error can be calculated at run-time.

The performance of the bit-depth reducing algorithm for generating multitone screens can be improved by using additional memory to calculate field statistics. For example, maximal spatial dispersion between overlapping dithering algebraic noise matrices is obtained when the modulo of ±C/3 (e.g., ±C/3 mod C) is added to green and blue dither matrices, and red dither matrix remains unchanged. As a result of this operation, three dither matrices R, G, and B can be defined as:

$$R_{xy}=M_{xy} \tag{4}$$

$$G_{xy}=(M_{xy}+C/3)\mathrm{mod}C \tag{5}$$

$$B_{xy}=(M_{xy}+2C/3)\mathrm{mod}C \tag{6}$$

The R, G, and B matrices can thus be used to dither red, green, and blue components of the input image, respectively. The dithering results can be further improved by using local and global image statistics f(Image) and g(x,y), respectively as shown below in Equations (7)-(9). However, to determine such information, additional memory is used, which can be disadvantageous for some small devices where memory is sufficiently limited.

$$R_{xy}=M_{xy} \tag{7}$$

$$G_{xy}=R_{xy}+f(\text{Image})+g(x,y) \tag{8}$$

$$B_{xy}=G_{xy}+f(\text{Image})+g(x,y) \tag{9}$$

Although no image-processing prior to multitoning is necessarily required, the bit-depth reducing algorithm for generating multitone screens can be used to successfully reduce color depth without significant visual artifacts. Additionally, a system using bit-depth reducing algorithm for generating multitone screens typically requires very little memory (only three numerical values are stored), which facilitates hardware implementation. The numerical values are determined using calculations such as addition, multiplication and modulo, which are easy to realize "in silicon." The price of gates is typically much lower than the price of implementing entire matrices, which makes this solution extremely cost effective.

Additionally, the algorithm for bit-depth reducing algorithm for generating multitone screens does not depend on the order of processing of image pixels (such as column-wise, row-wise, color plane-wise, and the like), which results in increased implementation flexibility. The relative simplicity of the bit-depth reducing algorithm for generating multitone screens and the lack of dependency on information about neighboring pixels enables on-the-fly calculation, and eliminates the need for a receiving (intermediate) buffer. The bit-depth reducing algorithm for generating multitone screens can thus be used in most existing chip configurations without requiring a complete chip redesign. Using existing chip configurations can significantly reduce the cost of the new product design.

Figure 6:
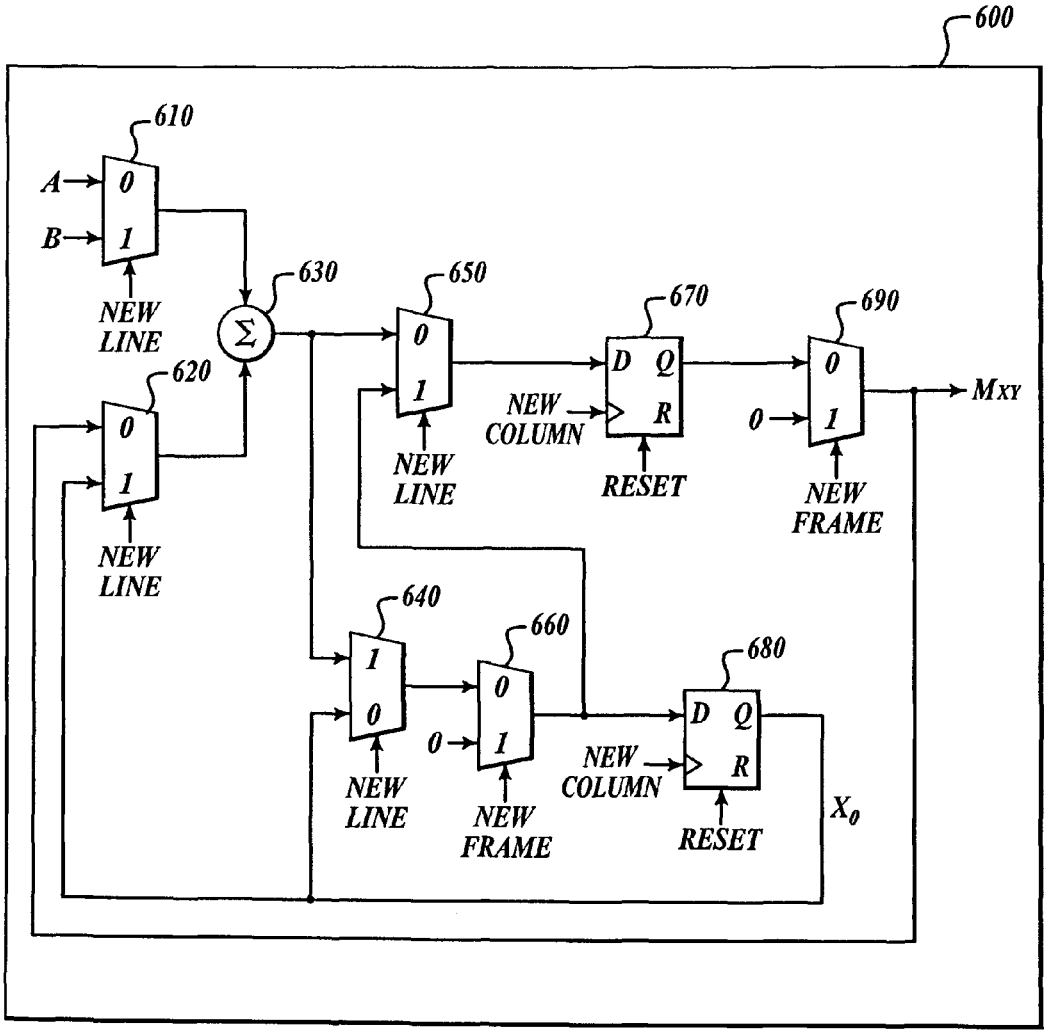
FIG. 6 is a schematic diagram illustrating a raster-order algebraic noise generator in accordance with the aspects of the present invention.

If the image data arrives in raster-order, the multipliers shown in FIG. 4 may be eliminated as shown in FIG. 5 and FIG. 6. FIG. 5 is a state diagram illustrating logic states of a raster-order algebraic noise generator in accordance with the aspects of the present invention. As shown below with reference to FIG. 6, an example algebraic noise generator can be implemented using two N-bit constants ("A" and "B"), two N-bit registers ("M" and "X0"), and one N-bit unsigned adder, which is used to calculate a value "M" for each new column, and to calculate "X0" at the start of each line. When "C" is assigned the value of $2^N$, the unsigned addition operation of (X0+B) mod C is repeated "C" times. Likewise, the unsigned addition operation of (M+A) mod C is also repeated "C" times. Thus an image of dimensions "C" by "C" can be dithered. When N is equal to twelve bits, example values for A, B, and C can be 2365, 3111, 4096, respectively. When N is equal to eight bits, example values for A, B, and C can be 149, 197, and 256, respectively.

The raster-order algebraic noise generator changes states in accordance with signal FLV as shown in state diagram 500. Signal FLV represents, for example, logic states associated in a video signal for the start of new frame, a new line, and a new column, respectively. For example, state 510 is entered upon a reset condition or when a new frame is present. When signal FLV indicates the logic state of "1XX" (where "1" represents a "true" state, and "X" represents a "don't care" state), the state of 510 is entered. Other states are entered when new addresses for rows and columns of a frame are encountered. State 520 is entered when a new line is encountered, such as when signal FLV is equal to the logic state of "01X." When state 520 is entered, a new value for X0 is calculated using the equation (X0+B) mod C (which uses the previous value of X0 that has been previously stored in a register). Additionally the value M is assigned the value of X0. The desired number of most significant bits (MSBs) from M can be used as the desired dither value.

State 530 is entered when a new column is encountered, such as 160 FLV is equal to the logic state of "001." When state 530 is entered, a new value for M is calculated using the equation (M+A) mod C (which uses the previous value of M that has been previously stored in a register). The logic flow remains in state 530 while signal FLV remains in the logic state "001."

State 540 can be entered from state 520 when signal FLV still remains in the logic state of "01X" and new values for X0 and M have been assigned. The logic flow remains in state 540 while signal FLV remains in the logic state "01X."

State 550 can be entered from state 530 one signal FLV remains in the logic state of "000" and a new value for M has been assigned. The logic flow remains in state 550 while signal FLV remains in the logic state "001."

FIG. 6 is a schematic diagram illustrating a raster-order algebraic noise generator in accordance with the aspects of the present invention. Generator 600 is arranged to operate in accordance with the state diagram 500 as discussed above. Generator 600 comprises six multiplexers (610, 620, 640, 650, 660, and 690), one adder (630), and two registers (670 and 680).

The reset signal is used to initialize registers 670 and 680 to a zero value. The new frame signal uses multiplexer 690 to reinitialize $M_{XY}$ to a value of zero and uses multiplexer 660 to reinitialize $X_0$. The new column signal stores new values for $M_{XY}$ and $X_0$ using register 670 and 680, respectively. The new lines signal is used to select between coefficients A and B using multiplexers 610, and between $M_{XY}$ and $X_0$ using multiplexer 620. The selected values are summed using adder 630. The new line signal uses multiplexer 640 to select between the summed value from adder 630 and the current value $X_0$ using. Additionally, the new line signal uses multiplexer 650 to select between the summed value from adder 630 and the output of multiplexer 660.

Although the invention has been described herein by way of exemplary embodiments, variations in the structures and methods described herein may be made without departing from the spirit and scope of the invention. For example, the positioning and/or sizing of the various components may be varied. Individual components and arrangements of components may be substituted as known to the art. Since many embodiments of the invention can be made without departing from the spirit and scope of the invention, the invention is not limited except as by the appended claims.

What is claimed is:

1. An apparatus for generating stochastic dither values in raster order for pixels of a frame, comprising:

a raster address generator that is configured to generate line and column addresses in a raster order;

a first register and a second register, wherein:

the first register is configured to store a current value X0 of the second register in response to a new line signal and to store a value of (M+A) mod C in response to a new column signal, where M is a current value of the first register, A is a constant, and C is a number of pixels in a line; and the second register is configured to store a value of (X0+B) mod C in response to the new line signal, where B is a constant, and where A, B and C are mutually prime; and an output configured to provide the value in the first register as a dither value.

2. The apparatus of claim 1, further comprising:

an adder that is configured to add an input pixel that corresponds to a current raster line and column address to the dither value provided by the output.

3. The apparatus of claim 1, wherein the apparatus is configured to calculate and store the values in the first and second registers in real time within a time required to display a line of video information divided by the number of pixels in the line.

4. The apparatus of claim 1, wherein:

the pixels comprise red, blue, and green color components; and each color component has at least two bits.

5. The apparatus of claim 1, further comprising an adder that is configured to add a value determined from local image information to the dither value provided by the output.

6. The apparatus of claim 1, further comprising an adder that is configured to add a value determined from global image information to the dither value provided by the output.

7. The apparatus of claim 1, wherein the output is configured to:

provide the value in the first register as a first dither value;

provide a value of a first function of the first dither value as a second dither value; and provide a value of a second function of the first dither value as a third dither value.

8. The apparatus of claim 7, wherein:

the first function is (M+C/3) mod C; and the second function is (M+2C/3) mod C.

9. A method for generating stochastic dither values in raster order for pixels of a frame, comprising:

generating line and column addresses in a raster order;

storing, in a first register, a current value X0 of a second register in response to a new line signal and a value of (M+A) mod C in response to a new column signal, where M is a current value of the first register, A is a constant, and C is a number of pixels in a line;

storing, in the second register, a value of (X0+B) mod C in response to the new line signal, where B is a constant, and where A, B and C are mutually prime; and outputting the value in the first register as a dither value.

10. The method of claim 9, further comprising adding input pixel information that corresponds to a current raster line and column address to the output dither value.

11. The method of claim 9, wherein the values are calculated and stored in the first and second registers within a time required to display a line of video information divided by the number of pixels in the line.

12. The method of claim 9, wherein:

the pixels comprise red, blue, and green color components; and each color component has at least two bits.

13. The method of claim 9, further comprising adding a value determined from local image information to the output dither value.

14. The method of claim 9, further comprising adding a value determined from global image information to the output dither value.

15. The method of claim 9, further comprising:

providing the value in the first register as a first dither value;

providing a value of a first function of the first dither value as a second dither value; and providing a value of a second function of the first dither value as a third dither value.

16. The apparatus of claim 15, wherein:

the first function is (M+C/3) mod C; and the second function is (M+2C/3) mod C.

17. An apparatus for dithering reduced-bit depth pixels, comprising:

means for generating line and column addresses in a raster order;

first and second means for storing, wherein:

the first means for storing is configured to store a current value X0 of the second means for storing in response to a new line signal and to store a value of (M+A) mod C in response to a new column signal, where M is a current value of the first means for storing, A is a constant, and C is a number of pixels in a line; and the second means for storing is configured to store a value of (X0+B) mod C in response to the new line signal, where B is a constant, and where A, B and C are mutually prime; and means for outputting the value in the first register as a dither value.

18. The apparatus of claim 17, further comprising means for adding input pixel information that corresponds to a current raster row and column address to the output dither value.

19. An apparatus for dithering raster-order image data, comprising:

a dither matrix generation circuit; and an adder circuit configured to add first, second, and third dither matrix values from the dither matrix generation circuit to first, second, and third color components, respectively, of the image data;

wherein the dither matrix generation circuit comprises a first register and a second register;

wherein the first register is configured to store a current value X0 of the second register in response to a new line signal and to store a value of (M+A) mod C in response to a new column signal, where M is a current value of the first register, A is a constant, and C is a constant;

wherein the second register is configured to store a value of (X0+B) mod C in response to the new line signal, where B is a constant, and where A, B, and C are mutually prime; and wherein the first dither matrix value is the value in the first register, the second dither matrix value is a value of a first function of the first dither matrix value, and the third dither matrix value is a value of a second function of the first dither matrix value.

20. The apparatus of claim 19, wherein:

the first function is (M+C/3) mod C; and the second function is (M+2C/3) mod C.

* * * * *